United States Patent [19]

Meling et al.

[11] Patent Number: 5,014,779

[45] Date of Patent: May 14, 1991

[54] DEVICE FOR EXPANDING PIPES

[76] Inventors: Konstantin V. Meling, ulitsa Gafiatullina, 27, kv. 20, Bugulma, U.S.S.R.; Jury A. Safonov, ulitsa Alisha, 5, kv. 6I, Bugulma, U.S.S.R.; Gabdrashit S. Abdrakhmanov, ulitsa Gogolya, 66, kv. 7I, Bugulma, U.S.S.R.; Jury G. Mikhailin, ulitsa Osipenko, 4, kv. 2I2, Kuibyshev, U.S.S.R.; Rodion M. Bogomolov, ulitsa Malogvardeiskaya, I09/II5, kv.25, Kuibyshev, U.S.S.R.; Valentin V. Salomatin, ulitsa Sklyarenko, 3, kv.I4, Kuibyshev, U.S.S.R.; Almaz A. Mukhametshin, ulitsa Gafiatullina, 26, kv. 5I, Bugulma, U.S.S.R.; Salikhzyan M. Mingazov, ulitsa G.Uspenskogo, 69, kv.3, Bugulma, U.S.S.R.

[21] Appl. No.: 555,507

[22] PCT Filed: Nov. 22, 1988

[86] PCT No.: PCT/SU88/00238

§ 371 Date: Aug. 2, 1990

§ 102(e) Date: Aug. 2, 1990

[87] PCT Pub. No.: WO90/05831

PCT Pub. Date: May 31, 1990

[51] Int. Cl.[5] ..... E21B 29/10

[52] U.S. Cl. ..... 166/55.7; 29/234; 29/523; 72/75

[58] Field of Search ..... 166/55, 55.7; 72/75, 72/118; 138/98; 29/523, 234, 283.5

[56] References Cited

U.S. PATENT DOCUMENTS

| | | | |
|---|---|---|---|
| 1,417,980 | 5/1922 | Dixon | 72/122 X |
| 1,594,114 | 7/1926 | Prout | 72/75 |
| 1,597,212 | 8/1926 | Spengler | 72/75 |
| 3,191,677 | 6/1965 | Kinley . | |
| 3;201,827 | 8/1965 | Reynolds et al. | 72/75 X |
| 3,528,498 | 9/1970 | Carothers . | |
| 3,818,734 | 6/1974 | Bateman . | |

FOREIGN PATENT DOCUMENTS

| | | |
|---|---|---|
| 371340 | 6/1973 | U.S.S.R. . |
| 394133 | 8/1973 | U.S.S.R. . |
| 467994 | 4/1975 | U.S.S.R. . |
| 432277 | 9/1975 | U.S.S.R. . |
| 599045 | 3/1978 | U.S.S.R. . |
| 859603 | 8/1981 | U.S.S.R. . |
| 1265284 | 10/1986 | U.S.S.R. . |

*Primary Examiner*—William P. Neuder
*Attorney, Agent, or Firm*—Lilling and Lilling

[57] ABSTRACT

The device is intended for expanding profile pipes set in a well for patching off a troublesome zone, and also for straightening crumpled casings.

The device comprises a housing (1) having an expanding member (3) mounted thereon in bearings (4, 5) on a journal (2) extending at an acute angel to the longitudinal axis of the housing (1). The expanding member (3) is shaped as a spherical segment (9) having its external surface defined by alternating portions of a spherical surface (10) and the lateral surfaces of cylinders (11) whose geometric axes being to a plane perpendicular to the axis (13) of the journal (2).

1 Claim, 1 Drawing Sheet

DEVICE FOR EXPANDING PIPES

FIELD OF THE ART

The present invention relates to well-drilling technologies, and, more particularly, it relates to a device for expanding pipes.

The invention can be employed to the utmost effect for expanding profile pipes used for patching off troublesome zones in a well-drilling operation, such troublesome zones being those associated with intense losses of the drilling mud and cement slurries, the inflow of either liquid or gas into the borehole from exposed formations, or caving-in of the rock being drilled.

PRIOR ART

It is not unfrequent nowadays that in the drilling of deep wells for oil or gas prodcution there are encountered formations which are incompatible from the drilling viewpoint, e.g., having abnormally high and low formation pressures, and also formations with the rock displaying a tendency towards crumbling or caving-in into the borehole.

The hitherto used practice has been to close off such formations by running into the well additional intermediate or curtailed casing strings. However, this practice involves considerable material inputs and costs incurred by the necessity of cementing the strings in the well and the need for additional metal, cement and operation time. Furthermore, with every additional casing string set, the diameter of the well becomes smaller, which adversely affects the production conditions.

At present, in order to provide for further drilling without reducing the predetermined diameter of the well, a portion of the well in the zone of an exposed troublesome formation has a patcher set therein, e.g., in the form of a string of profile pipes urged into engagement with the walls of the expanded portion of the well by building up fluid pressure inside them, followed by calibration of their internal passage to the predetermined well diameter by means of a pipe expanding device.

There is known a device for expanding casings (SU, A, 371340), comprising a housing rigidly connected with a tapering guide member with slots receiving therein the expanding members in the form of cylindrical rollers. The slots extend at an angle to the axis of the housing, their lowermost part being offset with respect to the uppermost part in the intended rotation direction of the device.

This known device is run on the drill pipe string into the well to face a crumpled portion of the casing string, and then rotated under a preset load, so that the rollers roll in engagement with the crumpled portion of the casing string, straightening it.

A drawback of this known device is its inadequate performance reliability, as the roller received in the slots of the tapering guide member of the housing are exposed to the hazard of hard particles suspended in the borehole fluid finding their way into the slots, causing jamming of the rollers, and with some of such particles being abrasive, their rapid wear.

Another shortcoming of the known device is the relatively low expansion rate imposed by the great friction forces experienced by the rollers in the slots of the tapering guide member of the housing.

There is further known a device for expanding well casings upon their crumpling in a well (SU, A, 467994), comprising a housing in the form of a direct tapering guide member made integral with an inverse tapering guide member, the guide members having slots receiving therein with the aid of bearing means the expanding members in the form of tapering rollers set at an angle to the geometric longitudinal axis of the housing and having their greater ends facing the centre of the housing.

The last-described device is operated similarly to the previously described one.

A major drawback of this device is the inadequate strength of the bearing means of its rollers, which prohibits the application to the device of a sufficiently heavy load, e.g., of a magnitude required for expanding profile pipes, which adversely affects the efficiency of expansion of pipes of this kind.

Another shortcoming of this last-described known device is its inadequate performance reliability, on account of the hazard of suspended particles of the borehole fluid, some of them abrasive, getting into the slots, threatening jamming of the rollers in the slots and their rapid wear.

Still another shortcoming of the known device is its relatively low efficiency on account of the great friction forces experienced by the rollers in the slots of the tapering guide members, particularly at moments when they become jammed in the slots of the guide members.

There is known yet another device for expanding pipes (SU, A, 394133), comprising a housing and an expanding member mounted in bearings on a journal at an angle with respect to the longitudinal geometric axis of the housing.

This device of the prior art, however, is of a complicated structure and of inadequate efficiency on account of the great friction forces in the working zone, which cuts down the effort transmitted from the expanding member to the pipe, so that this device of the prior art is suitable only for expanding the end portions of profile pipes.

It is an object of the present invention to enhance the performance reliability of a device for expanding pipes.

It is another object of the present invention to extend the service period of a device for expanding pipes.

It is yet another object of the present invention to speed up the process of expanding profile pipes, or else crumpled casings.

It is the main object of the present invention to create a device for expanding pipes, wherein the design of the expanding member should reduce significantly the friction in the zone of its engagement with a pipe, while at the same time stepping up the effort transmitted to the pipe.

DISCLOSURE OF THE INVENTION

This object is attained in a device for expanding pipes, comprising a housing having an expanding member mounted thereon in bearings on a journal at an angle with respect to the longitudinal axis of the housing, in which device, in accordance with the present invention, the expanding member is shaped as a spherical segment having its external surface defined by alternating portions of a spherical surface and the lateral surfaces of cylinders whose geometric axes belong to a plane perpendicular to the axis of the journal.

Owing to the disclosed streamlined shape of the working surface of the expanding member, the device in accordance with the present invention provides for reducing significantly the friction in the zone of its engagement with the pipe being worked upon, and also for stepping up considerably the effort transmitted to this pipe, thus substantially enhancing the quality of the expanding operation and stepping up its rate.

SUMMARY OF THE DRAWINGS

Other objects and advantages of the present invention will be made apparent in the following description of its preferred embodiment, with reference being made to the accompanying drawings, wherein.

PREFERRED EMBODIMENT OF THE INVENTION

Figure 2:
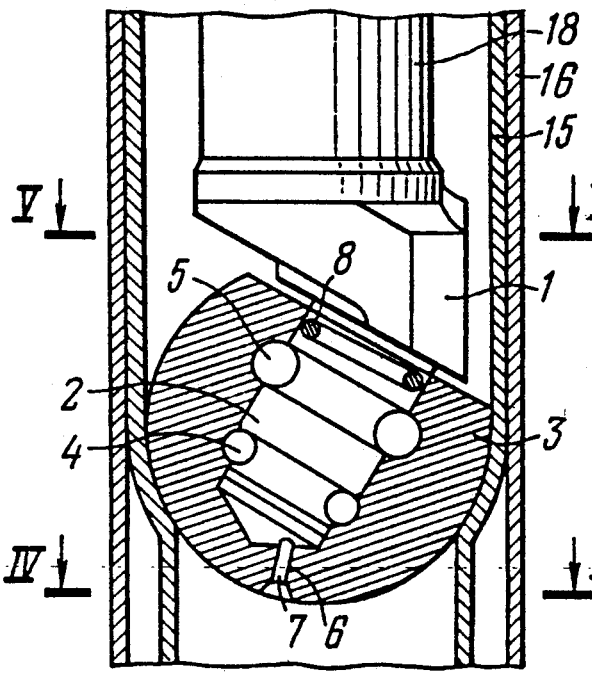
FIG. 2 shows the device of FIG. 1, with the expanding member shown in a sectional view.

The device for expanding pipes, embodying the present invention, comprises a housing 1 (FIG. 1) with a journal 2 (FIG. 2) having an expanding member 3 mounted thereon for rotation. The journal 2 extends at an acute angle to the longitudinal geometric axis of the housing 1, the expanding member 3 being mounted on the journal 2 with the aid of ball bearings 4 and 5. To inject lubricating grease into the bearings 4 and 5, the expanding member has an opening 6 closeable with a screw 7. A sealing element 8 seals off the area of engagement of the journal 2 with the expanding member 3.

Figure 3:
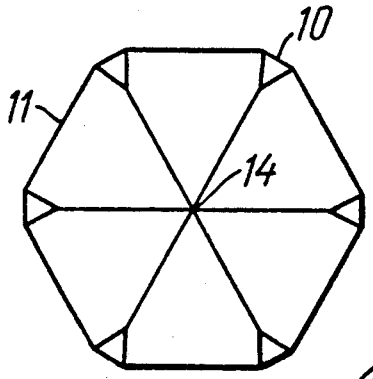
FIG. 3 is a view taken along arrow line A in FIG.1.

The expanding member 3 is shaped as a spherical segment 9 whose outer working surface is defined by alternating portions 10 of a spherical surface (see FIGS. 1 and 3) and the lateral surfaces of cylinders 11 whose respective geometric axes 12 belong to a plane perpendicular to the longitudinal geometric axis 13 of the journal 2 (i.e. extend at right angles with this axis 13) and include the centre "0" of the sphere defining the spherical segment 9. The common point 14 (FIG. 3) of intersection of the lateral surfaces of the respective cylinders 11 is at the apex of the expanding member 3.

The expanding member 3 may be in several modified versions (not shown), e.g. with the axes 12 being somewhat offset from the axis 13 of the expanding member 3 (i.e. of its journal 2) in a plane normal to this axis 13; or else with the plane including the axes 12 being shifted below the centre "0" of the expanding member 3; or else with the cylindrical surfaces 11 being substituted by concave (hyperbolic) surfaces of revolution.

The device is operated, as follows.

Figure 1:
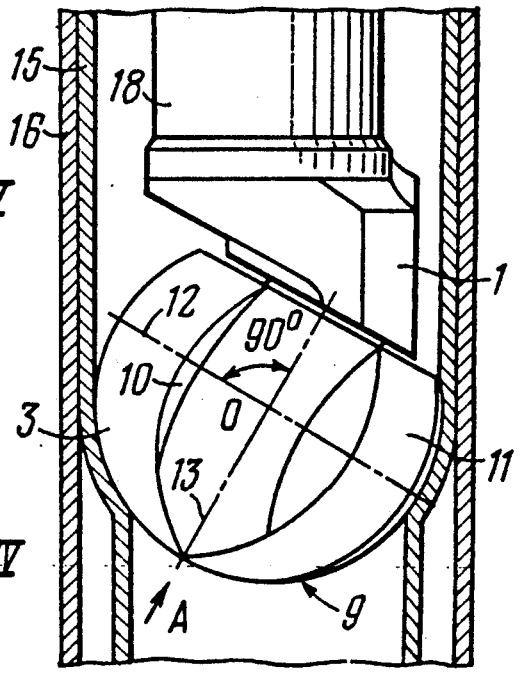
FIG. 1 is a general view of a device embodying the present invention in the operation of expanding a profile pipe in a well.
Figure 4:
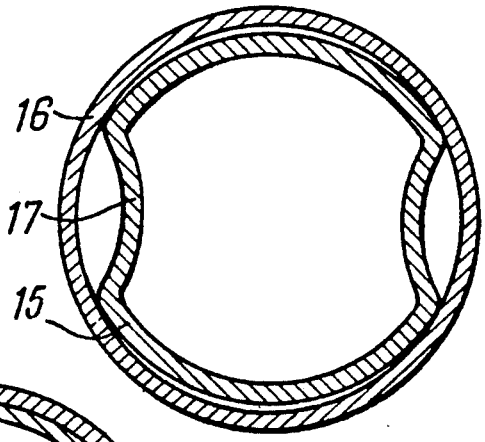
FIG. 4 is a sectional view taken on line IV—IV of FIG.2.
Figure 5:
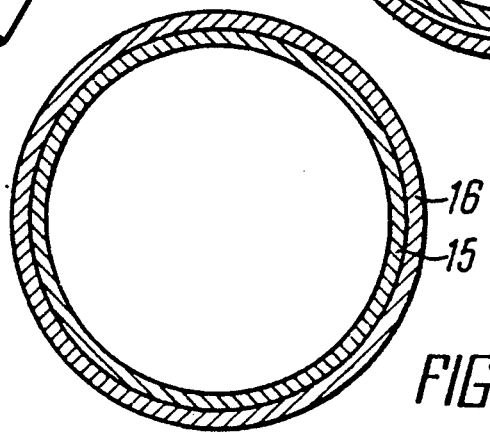
FIG. 5 is a sectional view taken on line V—V of FIG. 2.

With profile pipes 15 having been run into the borehole, or else into a casing string 16 (as shown in FIG. 1) for parching off a troublesome zone, and with the pipes 15 having been straightened from inside by excessive fluid pressure, they still have unstraigtened corrugations 17 (FIG. 4) left about their peripheries. The disclosed device is screwed onto the drill string 18 (FIGS. 1 and 2) and run into the borehole, or else into the casing string 16. Owing to the streamlined shape of its working surface, the expanding member enters the internal space of the profile pipes 15 and, with the drill pipe string 18 being rotated, straightens out the corrugations 17 unstraigtened by the fluid pressure, while at the same time calibrating the entire inner surface of the profile pipes 15 and urging them into tight engagement with either the wall of the borehole or the casing string 16, as shown in FIG. 5.

INDUSTRIAL APPLICABILITY

The invention can be used for expanding profile pipes used for patching off troublesome zones, as well as in repair of damaged pipes.

We claim:

1. A device for expanding pipes, comprising a housing (1) having an expending member (3) mounted thereon in bearings (4, 5) on a journal (2) at an angle with respect to the longitudinal axis of the housing (1), characterized in that the expanding member (3) is shaped as a spherical segment (9) having its external surface defined by alternating portions of a spherical surface (10) and the lateral surfaces of cylinders (11) whose geometric axes (12) belong to a plane perpendicular to the axis (13) of the journal (2).

* * * * *